United States Patent [19]

Smith

[11] Patent Number: 4,706,306

[45] Date of Patent: Nov. 17, 1987

[54] SINK STRAINER WITH BRIDGED STEM

[76] Inventor: Ronald A. Smith, 4784 Owl Circle, Mississauga, Ont., Canada, LZ4 1Z2

[21] Appl. No.: 23,268

[22] Filed: Mar. 9, 1987

[51] Int. Cl.[4] ..... A47K 1/14; E03C 1/26

[52] U.S. Cl. ..... 4/286; 4/287; 4/292; 4/290

[58] Field of Search ..... 4/286–292, 4/295

[56] References Cited

U.S. PATENT DOCUMENTS

| | | | |
|---|---|---|---|
| 1,741,242 | 12/1929 | Lemm | 4/287 |
| 1,961,277 | 6/1934 | Busse | 4/287 |
| 2,163,453 | 6/1939 | Schultis | 4/287 |
| 2,296,527 | 9/1942 | Kuhnle | 4/287 |
| 3,525,105 | 8/1970 | Richards | 4/287 |
| 4,232,407 | 11/1980 | Williams | 4/286 |

FOREIGN PATENT DOCUMENTS

| | | | |
|---|---|---|---|
| 1197653 | 12/1985 | Canada | 4/286 |

*Primary Examiner*—Henry K. Artis
*Attorney, Agent, or Firm*—Donald E. Hewson

[57] ABSTRACT

A stopper drain guide stem is provided for centering and positioning a stopper in a drain guide hole. The unitary guide stem has a spindle portion extending axially downwardly therefrom for attachment to a drain stopper. The downwardly extending flexible stem portion of the guide element has a radiused nose portion for supporting the drain stopper in its raised, draining position, and for centering the stem and guiding it into a central aperture of the drain body assembly. The intermediate length of the stem portion is bifurcated, having a pair of spaced apart, substantially parallel flexible leg portions with a flexible spacer member extending therebetween intermediate their length, to promote flexibility of the stem, so as to enable its use in a wider range of sizes of guide hole, and to enhance lateral stabilizing frictional engagement of the stem with the inner peripheral surface of the drain guide hole. The improved guide element can be used with a simple stopper having a stopper washer, or with a sink stopper including a perforated strainer basket. The enhanced flexbility of the legs enabling use in combination with a wider range of sizes of sink guide holes promotes the value and utility of the invention to the aftermarket.

10 Claims, 5 Drawing Figures

FIG.1.
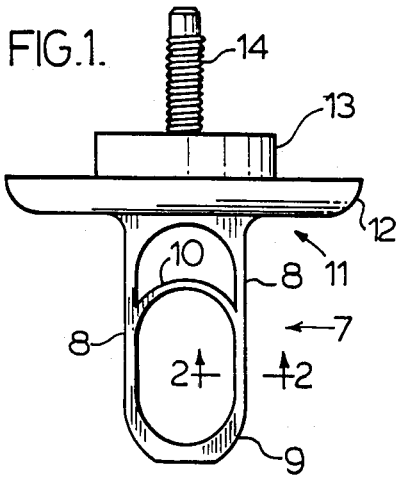
FIG. 2.
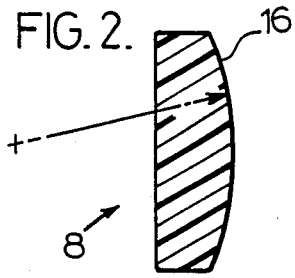
FIG.3.
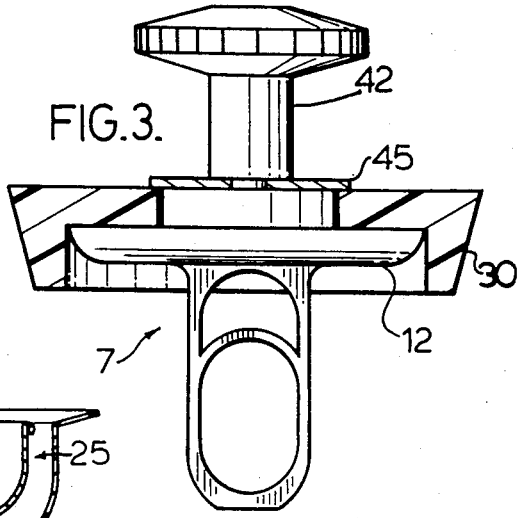
FIG.4.
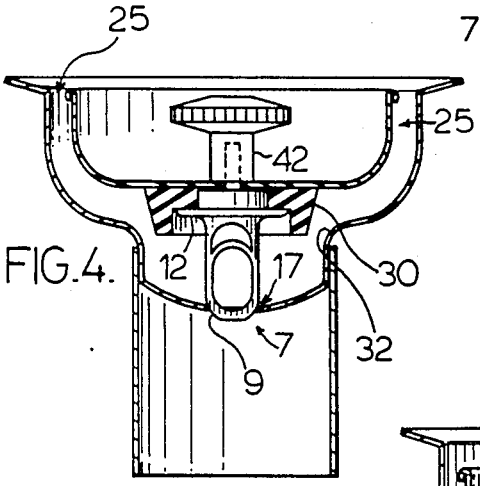
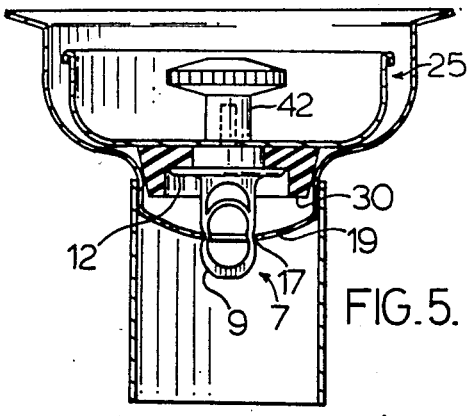
FIG.5.

SINK STRAINER WITH BRIDGED STEM

BACKGROUND OF THE INVENTION

This invention is directed to a stopper for use in the drain hole of a fixture such as a kitchen sink; and in particular to a stem guide element for engaging the stopper in a guide hole of the sink drain.

The provision of stoppers for use in conjunction with fixture drain holes has become highly specialized, and these widely used, common-place articles compete for market share in an economically significant market. Despite the proliferation of improvements in this general field, particularly as exemplified in the area of kitchen sink strainer basket type stoppers, progress continues to be made, as exemplified by the present invention.

In the case of prior art stopper stem embodiments, U.S. Pat. No. 3,525,105 Richards, issued August 1970 shows the use of a resilient spring steel stopper stem. The asembly of the stem by rivetting to its basket is most difficult and labour intensive. The stem is susceptible to damage, both by wearing of the transverse edges of the stainless steel spring, which can create hazardous cutting edges therein, and by accident such as dropping on the floor, or stepping on the stopper, which can bend or even break a leg or legs of the stem.

U.S. Pat. No. 4,232,407 Williams, issued November 1980 shows the use of a stopper stem comprising three or four depending fork tines which enter the guide hole of the fixture, to center and axially position the stopper within its fitting; also serving as a pedestal to support the stopper when it is in an upwardly withdrawn, draining condition. One disadvantage of the Williams stopper is that in moving the stopper from a draining position to a stoppering position, the stem has to be fairly precisely centered before it will enter the guidance aperture, located in the drain base spider. Thus, the centering effect of the guidance aperture is somewhat limited, and the size of guidance aperture also has to be closely controlled. Furthermore, owing to the segmented form of the stem, having three or four depending tangs, when the stem stands upon the centering spider, to support the strainer basket within the sink outlet in its function as a strainer, the basket readily becomes positioned off-center in its housing, thereby diminishing its effectiveness as a strainer.

Canadian Pat. No. 1,197,653, Mann, issued Dec. 10, 1985 shows a sink stopper having a very stiff plastic stem for use with drain guidance holes having a very restricted range of diameters.

SUMMARY OF THE INVENTION

The present invention thus provides a unitary stem for use with a fixture drain stopper, comprising an elongate hollow structure having a nose portion shaped to support the stopper when in a raised, draining position, and to facilitate entry of the stem, in use, into a guidance aperture in a drain housing; a pair of spaced apart flexible leg portions extending upwardly from the nose portion to define the hollow structure and joining a body portion having a flange portion extending laterally therefrom, spring means extending across the hollow structure and joining the leg portions intermediate their ends, to provide enhanced flexibility to the leg portions to accommodate to a wide range of sizes of guidance aperture, and local reinforcement, and to resist compressive radial displacement of the leg portions; and fastening means on the side of the flange portion remote from the leg portions, for securing the stem to a drain stopper.

The enhanced flexibility of the legs of the stem, that the bridge construction permits, enables use of the improved stopper in co-operation with guidance holes having a significantly larger range of hole diameter. This makes the improved stopper of particular attractiveness to the aftermarket, such as hardware stores and the like who sell replacement stoppers, for whom the greater tolerance to guidance hole size variation is very favourable. Thus, the average consumer has no idea of the specific diameter of the guidance hole in his sink, and the capability of offering a more universal replacement is both attractive and helpful to the retailer.

In comparing the subject stopper with the Richards, Williams, and Mann arrangements, the present leg portions are generally of sufficient flexibility, primarily with a view to ensuring the capability of utilization thereof in guidance holes having a significantly larger range of hole diameters, such that the flexible leg portions tend to expand and protrude above and below the guidance hole aperture, so as to virtually "grip" the drain housing, at the guidance aperture.

In contrast, the Richards, Williams and Mann arrangements are of such stiffness that there is virtually no tendency of the stem to so grip the guidance aperture of the drain housing. Furthermore, the range of sizes of guidance hole useable with the respective prior art stoppers is correspondingly restricted.

In the preferred embodiment the stem fastening means comprises a threaded spindle portion, to which an enlarged nut having a shaped head portion serving as a stopper handle, is threadedly and removably secured.

The threaded spindle and nut handle secure the stem to the washer portion of the stopper. In the case of a kitchen sink embodiment, a perforated strainer basket also is incorporated, having the stopper washer secured beneath the basket portion, and having the nut handle located within the basket.

The subject stem is generally cast in Delrin (TM) a flexible filled nylon material marketed in Canada by duPont, and having memory, as well as resistance to taking-up water, swelling, abrasion, scuffing and shaving, in its use within the environment of a sink stopper.

In the preferred embodiment the leg portions each have a cross section profile in which the radially outer surface is an arc of a circle corresponding generally with the radius of the guidance aperture wherein the spindle is inserted, in use.

While the most widespread use of the subject stem is in kitchen sinks, wherein a strainer basket and stopper are involved, the subject stem also is suited for incorporation with stoppers for wash hand basins, baths and the like.

BRIEF DESCRIPTION OF THE DRAWINGS

Certain embodiments are described, reference being made to the accompanying drawings, wherein:

FIG. 1 is a side elevation of the subject stem;

FIG. 2 is a section at 2—2 of FIG. 1;

FIG. 3 shows a side view of the stem in combination with a simple stopper;

FIG. 4 shows a side elevation, in diametrical section showing a sink base body assembly having a strainer basket stopper assembly in combination with the subject stem, illustrated in a raised draining condition; and FIG. 5 shows a view similar to FIG. 4 with the strainer assembly in a depressed, flow stopping position.

DETAILED DESCRIPTION OF THE EMBODIMENT

Referring to FIG. 1, the unitary stem 7 has a pair of legs 8, a radiused nose portion 9, a bridging spring portion 10, a body portion 11 having a flange 12 extending transversely therefrom, a centering spigot 13, and fastening means 14, comprising a threaded upper spindle portion.

Referring to FIG. 2, the radially outer leg surface 16 has a radius R substantially equal to the radius of an average guide hole 17 (see FIGS. 4 and 5) to afford transfer of stabilizing forces to the spindle 7 from the drain fixture guidance hole 17.

Referring to FIG. 3, the stem 7 has a washer 30 secured to the flange portion 12, with a spacer 45 and internally threaded handle 42 secured to the threaded spindle portion of stem 7.

Referring to FIGS. 4 and 5, the stem 7 is secured by way of handle 42 to a strainer basket 25, having a washer 30 in sandwiched relation between basket 25 and the flange portion 12. The stem 7 serves to secure the strainer basket 25 and stopper washer 30 in stable positioned relation, either in a first, raised condition shown in FIG. 4, resting by its radiused nose portion 9 in a draining position, or in a fully depressed stoppering position shown in FIG. 5, secured by the interaction of the legs 8 with the guidance aperture 17 in the perforated base 19. The stem 7 serves to position the basket 25 in centered relation both when raised or when fully depressed, so as to maintain the gap 28 substantially uniform.

Thus, it will be seen that the spring portion 10 permits a degree of flexibility in the legs 8 to enable use of the stopper in conjunction with aperture 17 in a large range of size. Furthermore the spring portion 10 conveys positional capability to the associated leg portions 8, and to the associated stem-stopper combination.

What is claimed is:

1. A unitary stem for use with a drain stopper for a fixture, said stem having an upper spindle portion including attachment means for securing the stem to said stopper, an intermediate flange extending transversely of the stem and a lower hollow stem portion bounded by leg portions extending downwardly, having a radiused nose portion at the lower end junction thereof, said legs being transversely flexible intermediate their ends, in use, during insertion and withdrawal of the stem from a guidance aperture of a drain housing, and spring means extending across said hollow stem portion in joining relation with said leg portions intermediate their ends, to resist transverse compressive deformation of said leg portions on passage thereof through said guidance aperture.

2. The stem as set forth in claim 1, in combination with said drain stopper said attachment means detachably securing said stopper and said stem in mutually secured relation.

3. The combination as set forth in claim 2, the ends of said spring means forming a pair of junctions with said leg portions, said radiused nose portion supporting said stem in centered relation in said guidance aperture when said drain stopper is in a first, raised, unstopped position.

4. The stem as set forth in claim 1, in combination with said drain stopper and with a strainer basket, said attachment means detachably securing said stopper, said strainer basket and said stem in mutually secured relation, having said stopper and said stem in depending relation beneath a lower face of said strainer basket.

5. The combination as set forth in claim 3, said junctions being located above said guidance aperture when said drain stopper is in said second, fully depressed stoppering position.

6. The stem as set forth in claim 2, said attachment means consisting of a threaded spindle portion and a handle portion having an internal thread removeably engaging said stem.

7. The stem as set forth in claim 1, said leg portions having a cross section profile in which the radially outer surface thereof is an arc of a circle, to provide an extended contact surface with said drain housing guidance aperture.

8. The stem as set forth in claim 1, in combination with said stopper, said hollow stem promoting precise centering and axial positional stability between said stopper and said drain housing aperture, when said stopper is in a first, raised condition, and when said stopper is in a second, fully inserted condition, to facilitate the elective location of said stopper in either a raised draining position or an inserted, stoppering position.

9. A sink strainer, comprising a strainer basket and, attached to the basket, a stem which protrudes downwards below the basket for insertion within a guidance aperture in a drain housing;

where the stem is a single unitary flat moulding of plastic material having substantially constant thickness throughout its length, and includes a through-slot that extends through the thickness of said stem and partway along its axial length, so as to define an undivided body portion and a divided body portion thereof;

where said divided portion has two legs, one on either side of said through-slot;

where said through-slot does not extend to the bottom of said plastic stem, so that said legs are joined by a bridging portion at the bottom of said plastic stem;

where said legs are flexibly resilient and deflectable towards each other, said through-slot being wide enough to permit such deflection;

where the outside profile of at least said bottom bridging portion includes a pair of radiused nose portions to facilitate entry of said legs in compressed inserted relation within said guidance aperture.

10. The strainer as set forth in claim 9, said legs being deformed inwardly by said guidance aperture, when in use, to protrude above and below said aperture, in gripping relation therewith.

* * * * *